US005451045A

United States Patent [19]

Garske

[11] Patent Number: 5,451,045

[45] Date of Patent: Sep. 19, 1995

[54] GOLF FLAG STICK WITH DRAINAGE FERRULE

[75] Inventor: Stephen J. Garske, Little Canada, Minn.

[73] Assignee: Par Aide Products Company, St. Paul, Minn.

[21] Appl. No.: 304,490

[22] Filed: Sep. 12, 1994

[51] Int. Cl.[6] ..... A63B 57/00

[52] U.S. Cl. ..... 273/34 R; 16/108; 116/173; 248/530

[58] Field of Search ..... 273/34 R, 181 R; 16/108, 109; 116/173, 174, 175; 248/530

[56] References Cited

U.S. PATENT DOCUMENTS

| | | | |
|---|---|---|---|
| D. 43,713 | 3/1913 | Campbell | 16/108 X |
| 1,534,652 | 4/1925 | Lorenz | 116/173 |
| 1,660,580 | 2/1928 | Schaum | 273/34 R |
| 1,676,954 | 7/1928 | Kannemann | 273/34 R |
| 1,744,985 | 1/1930 | Picha | 273/34 R |
| 3,000,656 | 9/1961 | Hollaender | 403/298 |
| 3,344,464 | 10/1967 | Ostrowski | 16/108 |
| 3,348,797 | 10/1967 | Turbyfill | 273/34 R X |
| 3,723,845 | 5/1973 | Istre | 116/173 |
| 4,111,577 | 9/1978 | Kiyosawa | 403/298 X |
| 4,114,879 | 9/1978 | Oiler | 273/34 R |
| 4,792,256 | 12/1988 | Batchelor | 403/296 |

FOREIGN PATENT DOCUMENTS 8695 of 1905 United Kingdom .

*Primary Examiner*—William H. Grieb
*Attorney, Agent, or Firm*—Kinney & Lange

[57] ABSTRACT

A golf flag stick with a drainage ferrule having a plurality of valleys or grooves and a plurality of lands or projections in its outer circumferential surface. The lands engaging the inner surface of a ferrule socket in a putting cup while the grooves allow water, sand and other debris to pass through the ferrule socket while the ferrule is in the socket because the plurality of grooves and the ferrule socket define drainage apertures.

26 Claims, 4 Drawing Sheets

GOLF FLAG STICK WITH DRAINAGE FERRULE

BACKGROUND OF THE INVENTION

The present invention relates to new and useful improvements in the flag sticks that are removably mounted in golf putting cups, more particularly, to a ferrule on which the flag pole is mounted.

Putting cups are typically 4¼ inches in diameter and approximately 6 inches tall. These putting cups are counter-sunk in a green on either a golf course or practice area so that the upper edge is about 1 inch below the surface of the green. Each putting cup contains a bore for receiving a ferrule. The ferrule is attached to the lower end of a flag stick, while the upper end typically has a flag thereon.

The ferrule needs to fit in the bore in a snug manner so that the flag stick remains in a vertical position. A sloppy fit between the ferrule and the bore in the cup will cause the flag stick to lean away from the vertical position. This leaning may result in the golfer aiming at the wrong position, i.e. the golfer aims for a position just below the flag when the putting cup is diagonally positioned below the flag. A leaning flag stick may also result in the blocking of the golf ball from going into the cup during a shot from off the green (i.e, when the flag is still in the putting cup). Furthermore, various weather conditions such as high wind or hail can cause the flag stick and flag to bend and flex in an uncontrollable manner. A loose fit could allow the flag stick to blow out of the bore. It is important that the flag stick remain firmly in the bore and after the high wind or hail, return to its original vertical positioning.

However, a fight fitting ferrule will not solve all of the problems encountered in the interaction between the ferrule and the bore. Another problem encountered on the golf course is sand and dirt accumulating in the putting cup. Often sand and dirt fall into the putting cup, particularly on a new golf course where the green has been built using large quantities of sand. This sand and dirt will accumulate around the ferrule and result in the ferrule sticking in the bore.

SUMMARY OF THE INVENTION

The present invention is directed to a ferrule construction which maintains the flag stick in a vertical position while providing for the flow of sand and dirt through the bore.

The present invention is a ferrule having a beveled surface which engages the surface bordering the bore in the cup, while having a plurality of vertical, i.e., longitudinal, grooves extending through the beveled surface and downward to the base of the ferrule. These longitudinal grooves allow water, sand and debris to pass between the ferrule and the putting cup.

DETAILED DESCRIPTION OF THE PREFERRED EMBODIMENTS

Figure 1:
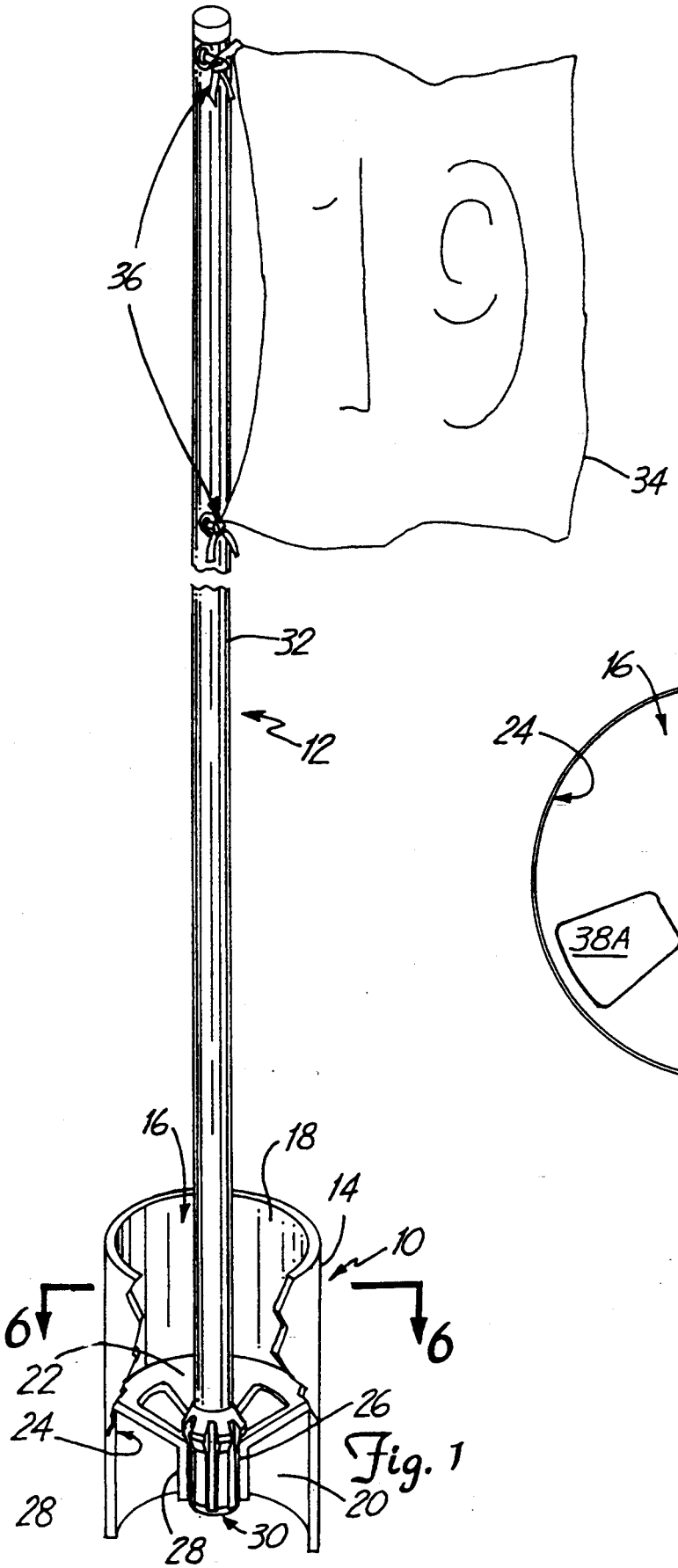
FIG. 1 is a perspective view of a sectioned putting cup with a flag stick having a ferrule, flag pole and flag therein.

A golf putting cup 10 with flag stick 12 inserted therein is shown in FIG. 1. Putting cup 10 is a cylinder 14 with a hollow center portion 16. Hollow center portion 16 is divided into an upper portion 18 and a lower portion 20 by an inclined or sloped surface 22 which has a downward slope from an inner surface 24 of cylinder 14 to a central hole or ferrule socket 26. Central hole 26 is defined by cylindrical wail 28 which extends downward from inclined surface 22.

Flag stick 12 includes a base or ferrule 30, a flag pole 32, and a flag 34. Flag stick 12 may also include connectors 36 for connecting flag 34 to flag pole 32. Connectors 36 can take many different forms including screws, clamps, slidable cylinders, bushings or other means of attaching a flag to a pole.

Ferrule 30 is insenable into central hole 26 such that ferrule 30 snugly fits within cylindrical wail 28. Ferrule 30 has a non-smooth outer surface, as described in more detail later in the specification.

Figure 2:
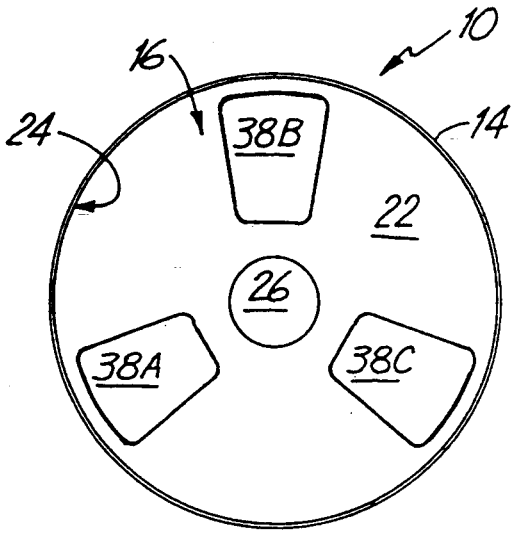
FIG. 2 is a top view of the putting cup.

A top perspective view of golf putting cup 10 is shown in FIG. 2. This view shows cylinder 14 and its hollow center portion 16 with inclined surface 22 therein. Inclined surface 22 contains central hole 26 and a plurality of water, sand and debris drainage apertures 38A, 38B and 38C. Ferrule 30 is insenable into central hole 26.

Golf putting cup 10 is typically inserted into the ground on a putting green where water, sand and other debris may wash into hollow cylinder 14. Inclined surface 22 extends into hollow cylinder 14 from inner surface 24. Any water, sand and debris that fails into upper portion 18 of hollow cylinder 14 will interact with inclined surface 22. Water, sand and debris drainage apertures 38A, 38B and 38C distribute some of the water, sand and debris downward into lower portion 20. However, because the slope of inclined surface 22 continues downward beyond drainage apertures 38A–38C to center hole 26, the water, sand and debris may build up in the area between central hole 26 and drainage apertures 38A–38C when ferrule 30 is in central hole 26. Sand and debris may also build up on inclined surface 22 in between drainage apertures 38A and 38B, 38B and 38C, and 38A and 38C.

When a standard ferrule having a smooth outer surface is used in central hole 26, all of this water, sand and debris partially or completely gathers around central hole 26 due to the downward slope of inclined surface 22 toward central bore 26. Drainage apertures 38A–38C only distribute some of the water, sand and dirt that fall into putting cup 10 due to their positioning part of the way up inclined surface 22. This sand and debris around central bore 26 results in the standard ferrule sticking in central bore 26.

Sticking of the ferrule in central bore 26 during a round of golf, particularly a tournament, can have drastic consequences. If a golfer is putting and the ferrule sticks while the caddy is trying to pull the flag out and the golf ball hits flag stick 12, a penalty is incurred by the golfer. Alternatively, the ferrule may stick in central bore 26 resulting in the removal of putting cup 10 from the ground when the caddy or other golfer pulls up on flag stick 12.

Figure 3:
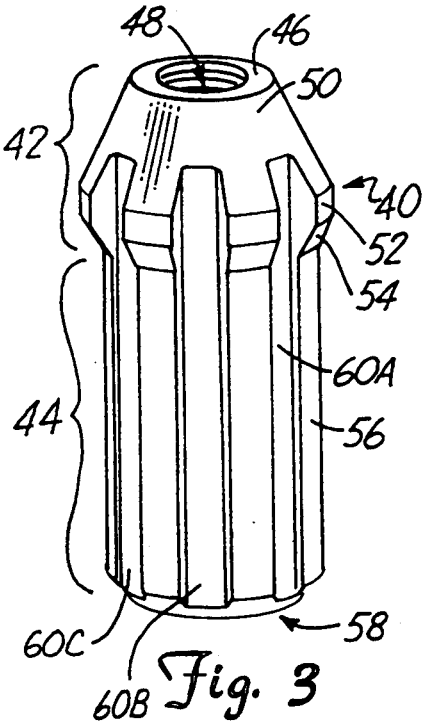
FIG. 3 is a perspective view of the ferrule taken generally from a side of the ferrule.

The new and improved ferrule construction of ferrule 30 is shown in more detail in FIG. 3. Ferrule 30 has a head portion 42 and a base portion 44. Head portion 42 includes a top surface 46 having a threaded aperture 48 therein, a sloped surface 50, an outer ridge 52, and a beveled surface 54. Base portion 44 includes an outer base surface 56 and a bottom surface 58.

Figure 4:
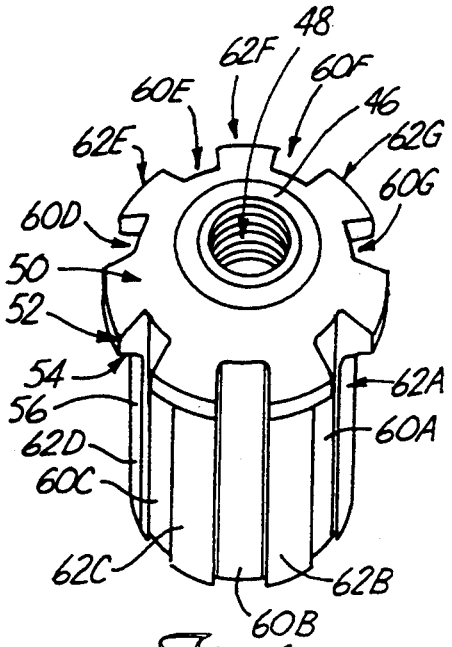
FIG. 4 is a perspective view of the ferrule taken generally from above the ferrule.

Both head portion 42 and base portion 44 include a plurality of longitudinal grooves, including grooves 60A, 60B and 60C. These grooves extend from the mid-section of head portion 42 downward through the base portion 44. FIG. 4 shows that the result of the plurality of grooves or valleys, namely 60A, 60B, 60C, 60D, 60E, 60F and 60G is that ferrule 30 is cylindrically shaped from the mid-point of head portion 42 to bottom surface 58 with the remaining portion of head portion 42 being beveled inward to top surface 46.

The portion of ferrule 30 that is generally cylindrical in shape consists of the plurality of grooves or valleys 60A–60G and a plurality of projections or lands 62A, 62B, 62C, 62D, 62E, 62F and 62G, where each valley is positioned in between a pair of these lands. FIG. 4 clearly shows all of the plurality of valleys 60A–60G and the plurality of lands 62A–62G and the positioning of each with reference to the other.

Figure 5:
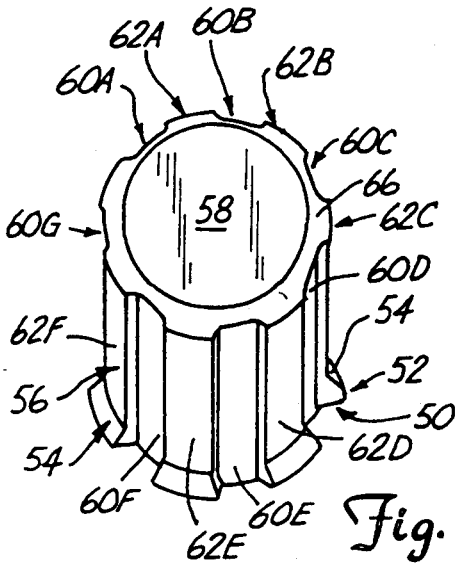
FIG. 5 is a perspective view of the ferrule taken generally from below the ferrule.

A bottom view of ferrule 30 is shown in FIG. 5. Bottom surface 58 includes a rounded or beveled edge surface 66. Plurality of grooves 60A–60G extend from rounded edge surface 66 through outer base surface 56, beveled surface 54, and outwardly extending ridge 52 into sloped surface 50.

Figure 6:
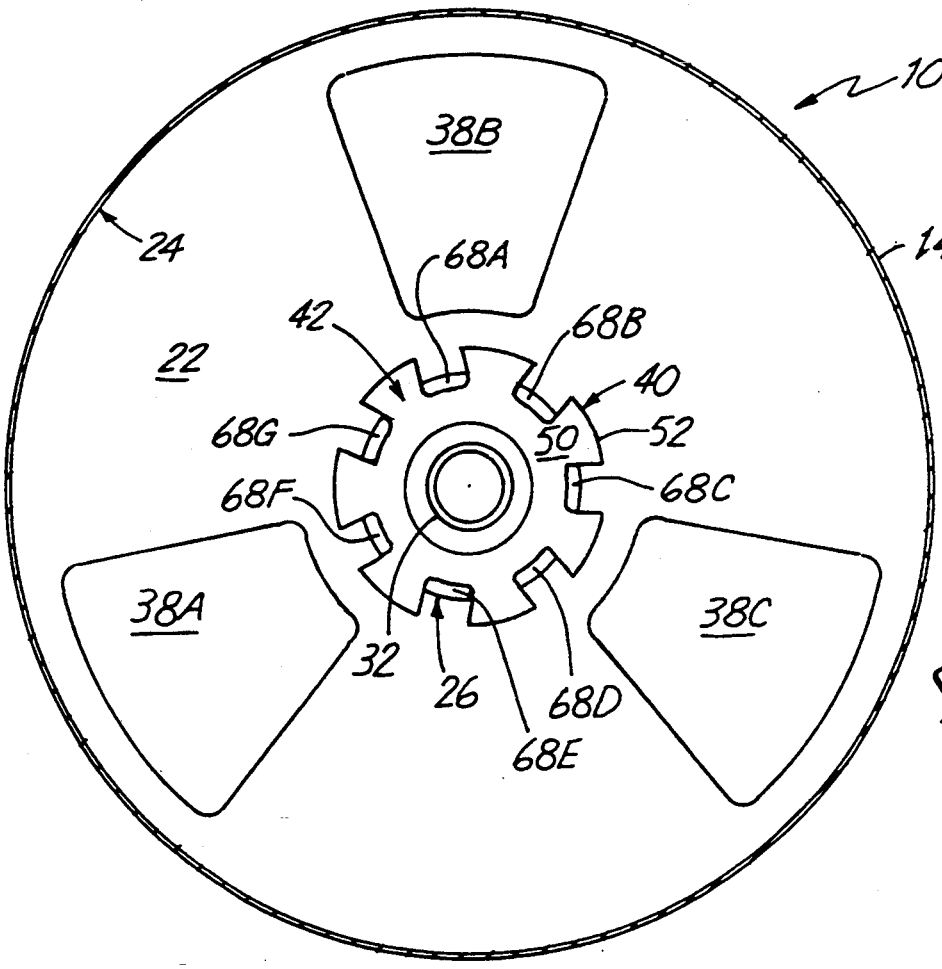
FIG. 6 is a sectional view taken along 6—6 in FIG. 1 of a portion of the cup with the ferrule and a portion of the flag pole therein.

Ferrule 30 is shown positioned within central hole 26 of golf putting cup 10 in FIG. 6. Base portion 44 fits within cylindrical wall 28 while head portion 42 is positioned above inclined surface 22. The plurality of lands 62A–62G engage cylindrical wall 28. The result of this improved ferrule construction is a plurality of water, sand and debris passageways 68A, 68B, 68C, 68D, 68E, 68F and 68G in between the plurality of valleys 60A–60G and cylindrical wall 28. These passageways 68A–68G allow water, sand and debris which build up on inclined surface 22 around central hole 26 to pass through central hole 26 even though ferrule 30 is tightly engaged within cylindrical wall 28. The tight engagement allows a flag stick 12 to be connected to threaded aperture 48 and extend in substantially a vertical manner therefrom.

Figure 7:
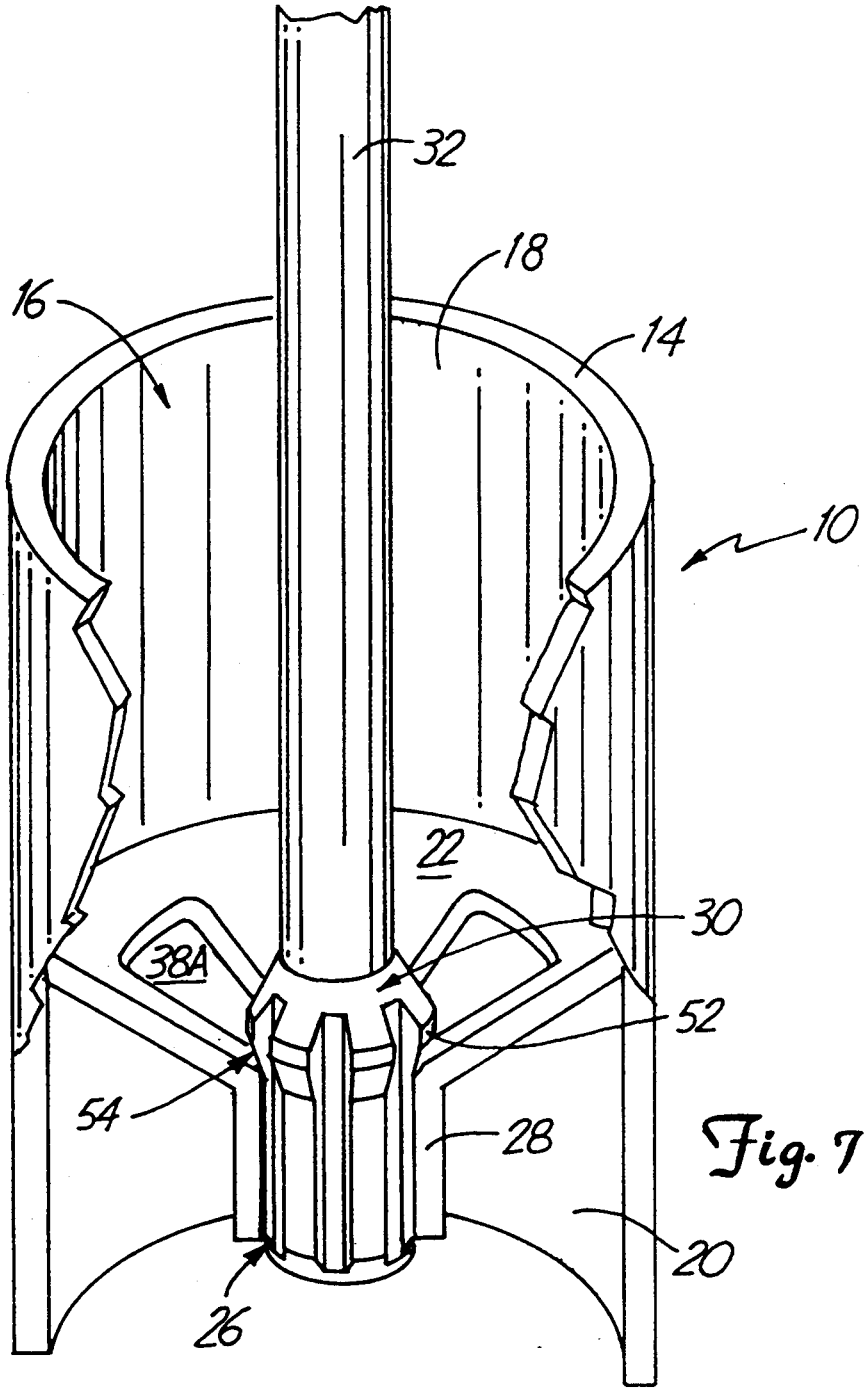
FIG. 7 is an enlarged side perspective view of the cup with a portion of the cup cut away to show the ferrule and a portion of the flag pole.

FIG. 7 shows ferrule 30 interacting with golf putting cup 10. Base portion 44 is fully inserted into central hole 26 such that base portion 44 tightly engages cylindrical wall 28. Beveled surface 54 rests upon the portion of inclined surface 22 that surrounds central hole 26. This prevents head portion 42 from extending into central hole 26. Each of the plurality of grooves 60A–60G defines with cylindrical wall 28 a plurality of water, sand and debris duets or passageway 68A–68G, respectively. These passageways 68A–68G allow water, sand and other debris to pass through central hole 26 when ferrule 30 is therein. The result is the water, sand and debris accumulate below central hole 26 in lower portion 20. This allows ferrule 30 to be easily removed and reinserted into central hole 26 as needed.

The present invention is a non-uniform ferrule construction resulting in water, sand and debris passageways between the ferrule and the central hole of the putting cup while still allowing a tight ferrule fit. The result is a substantially decreased likelihood of a penalty stroke based upon the golfer's ball hitting the pin because the caddy or other golfer could not get the pin out of the ferrule bore after the golfer aligned his shot but before the ball reached the putting cup. The result also involves a decrease in the likelihood that the removal of the pin will result in the removal of the putting cup from the ground.

Although the present invention has been described with reference to preferred embodiments, workers skilled in the art will recognize that changes may be made in form and detail without departing from the spirit and scope of the invention.

What is claimed is:

1. A flag stick for use in conjunction with a golf course putting cup having a ferrule socket, comprising:
   a flag pole having upper and lower ends, the lower end including a ferrule connector; and
   a ferrule having a head portion and a base portion insertable into the ferrule socket, the head portion including a top surface with a flag pole connector therein and a head surface, the base portion including a base surface, wherein the head and base surfaces define at least one longitudinal groove.

2. The flag stick of claim 1 wherein the head portion includes a ridge.

3. The flag stick of claim 1 wherein the head portion includes a top surface and a ridge resulting in the head surface sloping outward from the top surface to the ridge.

4. The flag stick of claim 3 wherein the head portion includes a beveled surface resulting in the head surface sloping inward from the ridge to the base portion.

5. The flag stick of claim 1 wherein the head surface and the base surface define a plurality of lands, each of the lands extending substantially vertically through the base surface and partially through the head surface.

6. The flag stick of claim 5 wherein the plurality of lands includes seven lands.

7. The flag stick of claim 1 wherein the head surface and the base surface define a plurality of grooves, each of the grooves extending substantially vertically through the base surface and partially through the head surface.

8. The flag stick of claim 7 wherein the plurality of grooves includes seven grooves.

9. The flag stick of claim 1 wherein the flag pole connector comprises an aperture in the head portion.

10. A ferrule securable to a flag pole that is insertable into a ferrule socket in a putting cup, the ferrule comprising:
   an upper portion having a flag pole connector; and a lower portion insertable into the ferrule socket, wherein at least a portion of the upper portion and the lower portion define at least one drainage groove extending longitudinally along at least part of the upper portion and the lower portion.

11. The ferrule of claim 10 wherein the upper portion includes a ridge.

12. The ferrule of claim 10 wherein the upper portion includes a top surface and a ridge resulting in the upper portion sloping outward from the top surface to the ridge.

13. The ferrule of claim 12 wherein the upper portion includes a beveled surface resulting in the upper portion sloping inward from the ridge to the lower portion.

14. The ferrule of claim 10 wherein the upper portion and the lower portion define a plurality of lands, each of the lands extending substantially vertically through the lower portion and partially through the upper portion.

15. The ferrule of claim 14 wherein the plurality of lands includes seven lands.

16. The ferrule of claim 10 wherein the upper portion and the lower portion define a plurality of grooves, each of the grooves extending substantially vertically through the lower portion and partially through the upper portion.

17. The ferrule of claim 16 wherein the plurality of grooves includes seven grooves.

18. The ferrule of claim 10 wherein the flag pole connector comprises a threaded aperture in the upper portion.

19. A ferrule securable to a flag pole that is insertable into a ferrule socket in a putting cup, the ferrule comprising:

an upper portion defining a first cross sectional area and having a flag pole connector therein; and a lower portion defining a second cross sectional area and having a base surface insertable into the ferrule socket, wherein at least one groove extends longitudinally from the upper portion to the lower portion, and wherein the first cross sectional area is greater than the second cross sectional area.

20. The flag stick of claim 19 wherein the ferrule further includes a shoulder between the upper portion and the lower portion.

21. A flag stick for use in conjunction with a golf course putting cup having a ferrule socket, comprising:

a flag pole; and a ferrule having an upper end connectable to the flag pole, a lower end insertable into the ferrule socket, a shoulder between the upper and lower ends, and at least one drainage duct for allowing the ferrule to engage the ferrule socket while providing a passageway within the ferrule socket.

22.. The flag stick of claim 21 wherein the shoulder comprises a ridge and a beveled surface wherein the beveled surface extends outward from the ferrule to a ridge.

23. The flag stick of claim 22 further comprising a sloped surface from the ridge to a top surface on the upper end.

24. The flag stick of claim 23 further comprising a cylindrical portion for insertion into the ferrule socket in the putting cup where the cylindrical portion extends from the beveled surface to a base surface on the lower end.

25. A flag stick for use in conjunction with a golf course putting cup having a ferrule socket, comprising:

a flag pole; and a ferrule having an upper end connectable to the flag pole, a lower end insertable into the ferrule socket, a shoulder between the upper and lower ends, and a plurality of lands extending outward from at least a portion of the upper and lower ends thereby defining a plurality of longitudinal grooves extending inward through the shoulder and at least a portion of the upper and lower ends wherein the plurality of lands engages the ferrule socket when inserted therein while the plurality of grooves allows for drainage through the ferrule socket when the ferrule is therein.

26. The flag stick of claim 25 wherein the shoulder includes a stop in the form of a beveled surface for restricting the ferrule from further insertion into the ferrule socket.

* * * * *

UNITED STATES PATENT AND TRADEMARK OFFICE

CERTIFICATE OF CORRECTION

PATENT NO. : 5,451,045

DATED : September 19, 1995

INVENTOR(S) : STEPHEN J. GARSKE

It is certified that error appears in the above-indentified patent and that said Letters Patent is hereby corrected as shown below:

Col. 2, line 25, delete "insenable", insert --insertable--

Signed and Sealed this

Twelfth Day of December, 1995

*Attest:*

Bruce Lehman

BRUCE LEHMAN

*Attesting Officer*

*Commissioner of Patents and Trademarks*